US006643888B2

(12) United States Patent
Griffith

(10) Patent No.: US 6,643,888 B2
(45) Date of Patent: Nov. 11, 2003

(54) GRILL CLEANING TOOL

(76) Inventor: Jerry Griffith, 166 Noya Way, Loudon, TN (US) 37774

( * ) Notice: Subject to any disclaimer, the term of this patent is extended or adjusted under 35 U.S.C. 154(b) by 90 days.

(21) Appl. No.: 10/020,626

(22) Filed: Dec. 6, 2001

(65) Prior Publication Data

US 2002/0042964 A1 Apr. 18, 2002

(51) Int. Cl.[7] ..... A47L 13/08

(52) U.S. Cl. ..... 15/236.06; 15/236.07; 15/236.09; 30/172; D32/48; D32/49

(58) Field of Search ..... 15/236.01, 236.05–236.09; D32/46–49; 30/171, 172

(56) References Cited

U.S. PATENT DOCUMENTS

| | | | | | |
|---|---|---|---|---|---|
| 1,145,966 | A | * | 7/1915 | Bergmann | 15/236.07 X |
| 2,824,323 | A | * | 2/1958 | Tos et al. | 15/236.09 X |
| 3,366,987 | A | * | 2/1968 | Giustino | 15/236.08 X |
| 3,487,491 | A | * | 1/1970 | Dunn | 15/236.05 X |
| 3,719,993 | A | * | 3/1973 | Caprioli | 30/172 |
| 3,800,354 | A | * | 4/1974 | Stephens | 15/236.06 |
| 3,820,185 | A | | 6/1974 | Phillips | 15/105 |
| 3,955,234 | A | * | 5/1976 | Roefaro | 15/236.06 |
| D247,278 | S | | 2/1978 | Dunn, Jr. | 32/46 |
| 4,305,175 | A | * | 12/1981 | Burgess, Jr. | 15/236.06 X |
| D264,543 | S | * | 5/1982 | Ashley | D32/49 |
| 4,471,985 | A | | 9/1984 | Mahoney | 294/10 |
| D294,416 | S | * | 2/1988 | Carroll | D32/48 |
| 4,801,166 | A | | 1/1989 | Jordan et al. | 294/9 |
| D304,892 | S | * | 12/1989 | Bevilacqua | D32/46 |
| 4,984,324 | A | * | 1/1991 | Farris | 15/236.05 |
| 5,729,854 | A | | 3/1998 | Powers | 7/109 |
| 5,987,693 | A | * | 11/1999 | Noga | 15/236.08 |
| 6,000,739 | A | | 12/1999 | Zemit et al. | 294/9 |

FOREIGN PATENT DOCUMENTS

| | | | | |
|---|---|---|---|---|
| CH | 151620 | * | 5/1932 | 30/172 |
| CH | 176551 | * | 6/1935 | 15/236.06 |
| CH | 672081 | * | 10/1989 | 15/236.07 |
| DE | 804859 | * | 4/1951 | 15/236.08 |
| SE | 127180 | * | 1/1950 | 15/236.05 |

* cited by examiner

*Primary Examiner*—Mark Spisich
(74) *Attorney, Agent, or Firm*—Michael E. McKee

(57) ABSTRACT

A grill cleaning tool for cleaning a surface of a grill grate provided, for example, by a rod or bar includes an elongated shaft having a proximal end portion capable of being grasped by a user and an opposite distal end portion and utilizes a plurality of substantially planar cutting members attached to the distal end portion of the shaft in a substantially parallel relationship to one another. Each cutting member defines a series of cutting edges around its perimeter, and the cutting members are arranged so that a plurality of cutting edges defined thereby are positioned in substantially linear registry with one another so that the cutting edges which are in linear registry with one another can be placed in simultaneous engagement with the surface of a grill grate and guided therealong with the cutting edges in scraping engagement with the surface. In addition, the cutting edges disposed around the perimeter of the members possess different shapes and sizes to accommodate the use of the tool for cleaning a grate surface possessing any of a number of shapes or sizes.

3 Claims, 3 Drawing Sheets

GRILL CLEANING TOOL

BACKGROUND OF THE INVENTION

This invention relates generally to means and methods for cleaning grills, such as barbecue grills, and relates, more particularly, to tools used to clean the surfaces of the grates of such grills.

Grill cleaning tools commonly employ a cutting edge for scraping cooking deposits from the surfaces provided, for example, by rods or bars of grill grates. Examples of such tools are shown and described in U.S. Pat. Nos. 3,820,185, 4,471,985, 5,729,854 and 6,000,739. However, the grill cleaning tools of the referenced patents are limited in that they are incapable of cleaning surfaces whose shape or size may fall anywhere within a broad range of shapes or sizes. Moreover, each of these prior art tools normally requires several back and forth scraping motions in order to satisfactorily remove cooking deposits from the surface of a grill grate.

It is an object of the present invention to provide a new and improved grill cleaning tool which is capable of cleaning surfaces of grill grates wherein the surfaces of such grates have a shape or size which falls anywhere within a broad range of shapes or sizes.

Another object of the present invention is to provide such a grill cleaning tool which can be used to adequately remove cooking deposits from the surfaces of grill grates with fewer back and forth scraping motions than was required with grill cleaning tools of the prior art.

Still another object of the present invention is to provide such a grill cleaning tool which is uncomplicated in construction, easy to use and effective in operation.

SUMMARY OF THE INVENTION

This invention resides in a grill cleaning tool for cleaning a surface of a grill grate.

The tool includes a shaft having two opposite ends, one end of which is adapted to be grasped by a user for use of the tool, and means associated with the end of the shaft opposite said one end defining a plurality of parallel cutting edges which are capable of being placed in simultaneous engagement with the surface of a grill grate to be cleaned. By moving the tool along the grate surface while the parallel cutting edges are in simultaneous engagement therewith, each of the cutting edges is guided in scraping engagement with the surface.

DETAILED DESCRIPTION OF AN ILLUSTRATIVE EMBODIMENT

Figure 1:
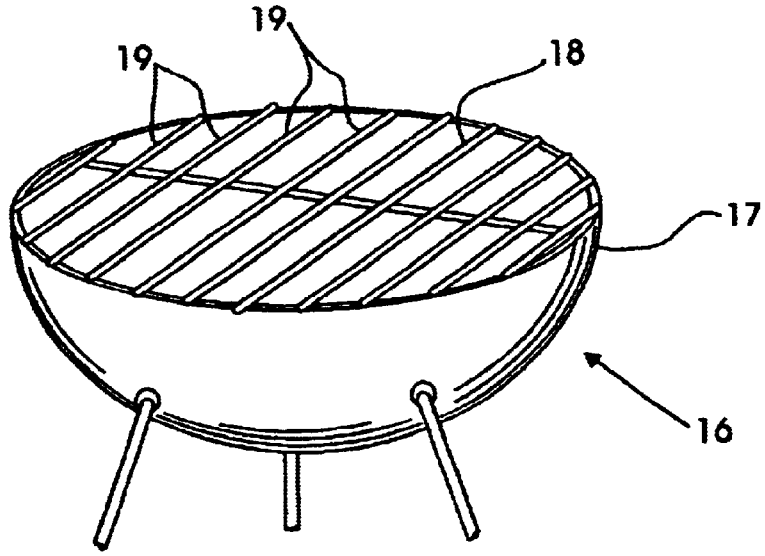
FIG. 1 is a fragmentary perspective view of a grill having a grate whose surfaces are capable of being cleaned by a grill cleaning tool embodying features of the present invention.
Figure 2:
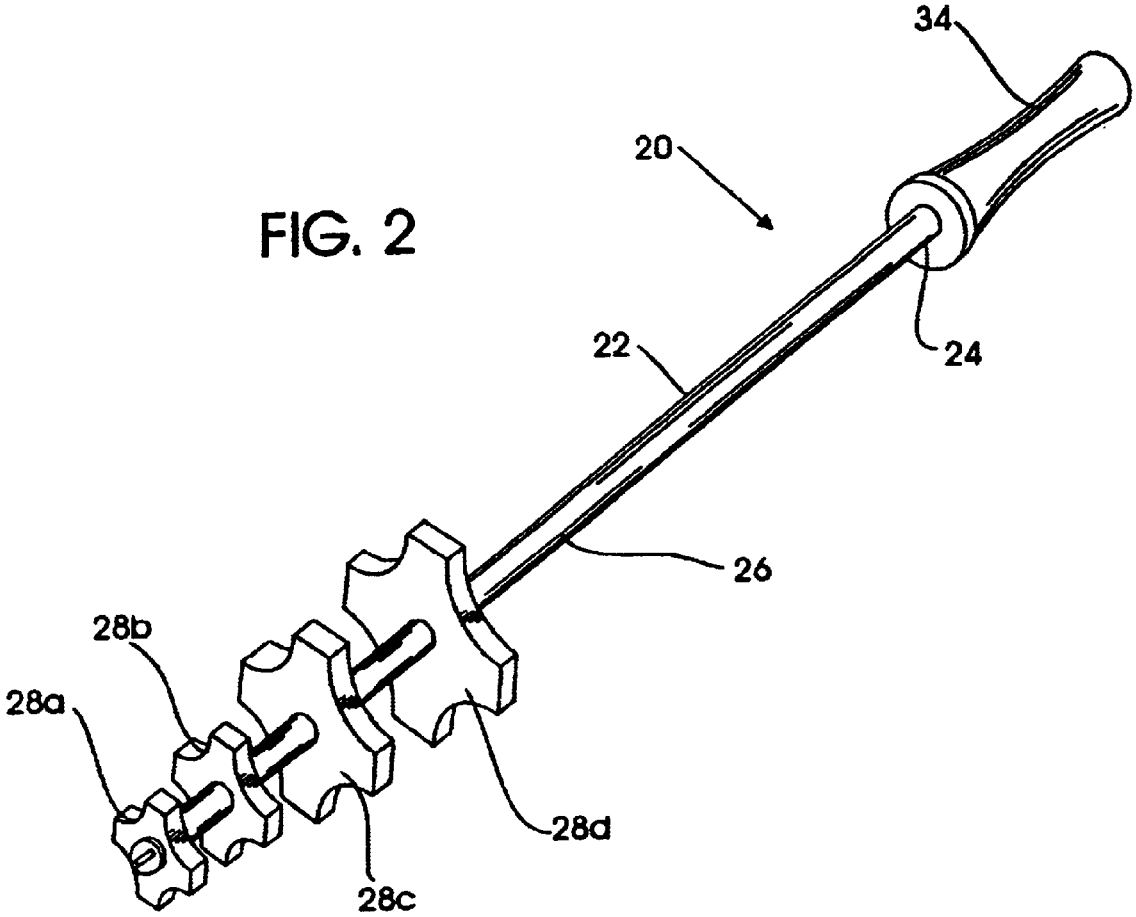
FIG. 2 is a perspective view of an embodiment of a grill cleaning tool embodying features of the present invention.

Turning now to the drawings in greater detail, there is illustrated in FIG. 1 an exemplary grill, indicated 16, of the class which can be cleaned with the grill cleaning tool, generally indicated 20 in FIG. 2, within which features of the present invention are embodied. The FIG. 12 grill 16 is known in the art as a barbecue grill having a cavity or receptacle 17 within which a cooking flame is generated and a grill grate 18 supported over the receptacle 17 for providing a supporting surface upon which food items to be cooked are placed. The grate 18 includes a plurality of spaced rods 19 which are likely to become built up with cooking deposits (e.g. food and/or flame residue) resulting from the cooking process and consequently require frequent cleaning. Along the same lines, the build-up of rust and corrosion on the surfaces of the rods 19 requires cleaning, as well. As will be apparent herein, the grill cleaning tool 20 can be used to readily scrape cooking deposits, as well as any rust and corrosion, from the grill rods 19 to thereby clean the grill 16.

Although the surfaces of the grill grate 18 are provided by rods 19 which are cylindrical in cross section, it will be appreciated that surfaces of grill grates can be provided by rods or bars possessing alternative shapes and sizes. As will be apparent herein, the tool 20 described herein is capable of cleaning surfaces of grill grates possessing any of a number of shapes and sizes. Accordingly and although the tool 20 is described herein in connection with the cleaning of rods 19 of cylindrical in cross section, the use of the tool 20 is not limited to cylindrically-shaped rods.

Figure 3:
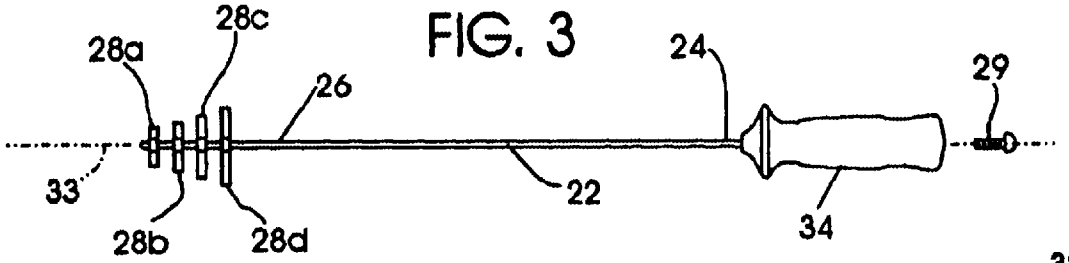
FIG. 3 is a side elevational view of the FIG. 2 embodiment.

With reference to FIGS. 2 and 3, the grill cleaning tool 20 includes an elongated shaft 22 having a proximal end portion 24 and an opposite distal end portion 26 to which a plurality of planar cutting members 28*a*–28*d* are attached. The cutting members 28*a*–28*d* define cutting edges, described herein, which can be guided in scraping engagement with and along each rod 19 (FIG. 1) of the grill 20.

The elongated shaft 22 is substantially straight and cylindrical in shape along a major section of its length, and one side of its distal end portion 26 (as best viewed in FIG. 4) is cut-away to provide a flattened area 30 which extends between a shoulder surface 32 (oriented substantially normal to the longitudinal axis, indicated 33, of the shaft 22) and the tip 35 of the shaft 22. As will be apparent herein, this flattened area 30 provides the distal end portion 26 with a non-circular cross section which helps to prevent the cutting members 28*a*–28*d* from being rotated around the shaft 22 during use of the tool 20. Provided within the tip 35 of the shaft 22 is an internally-threaded opening 36 which extends axially along the shaft 22 and whose purpose is apparent herein. The depicted shaft 22 is constructed of steel, but alternative materials can be used.

With reference again to FIGS. 2 and 3, there is attached to the proximal end portion 24 of the shaft 22 a handle 34 which is shaped to be comfortably grasped by the hand of a user for use of the tool 20. The handle 34 is formed as a one-piece unit (out of a suitable material, such as metal or wood) having a central opening extending along its longitudinal axis for receiving the proximal end portion 24 inserted end-first therein. Securement of the handle 34 to the shaft 22 can be effected with a set screw 29 (FIG. 3) inserted through the butt of the handle 34 and screwed into the distal end of the shaft 22, or the handle 34 can simply be force-fitted over the distal end of the shaft 22 for securement thereto. Although the handle 34 and shaft 22 of the depicted tool 20 have been shown and described as being constructed as separate components which are subsequently secured together, the handle and shaft can be constructed (e.g. molded) as a single, unitary structure.

Figure 4:
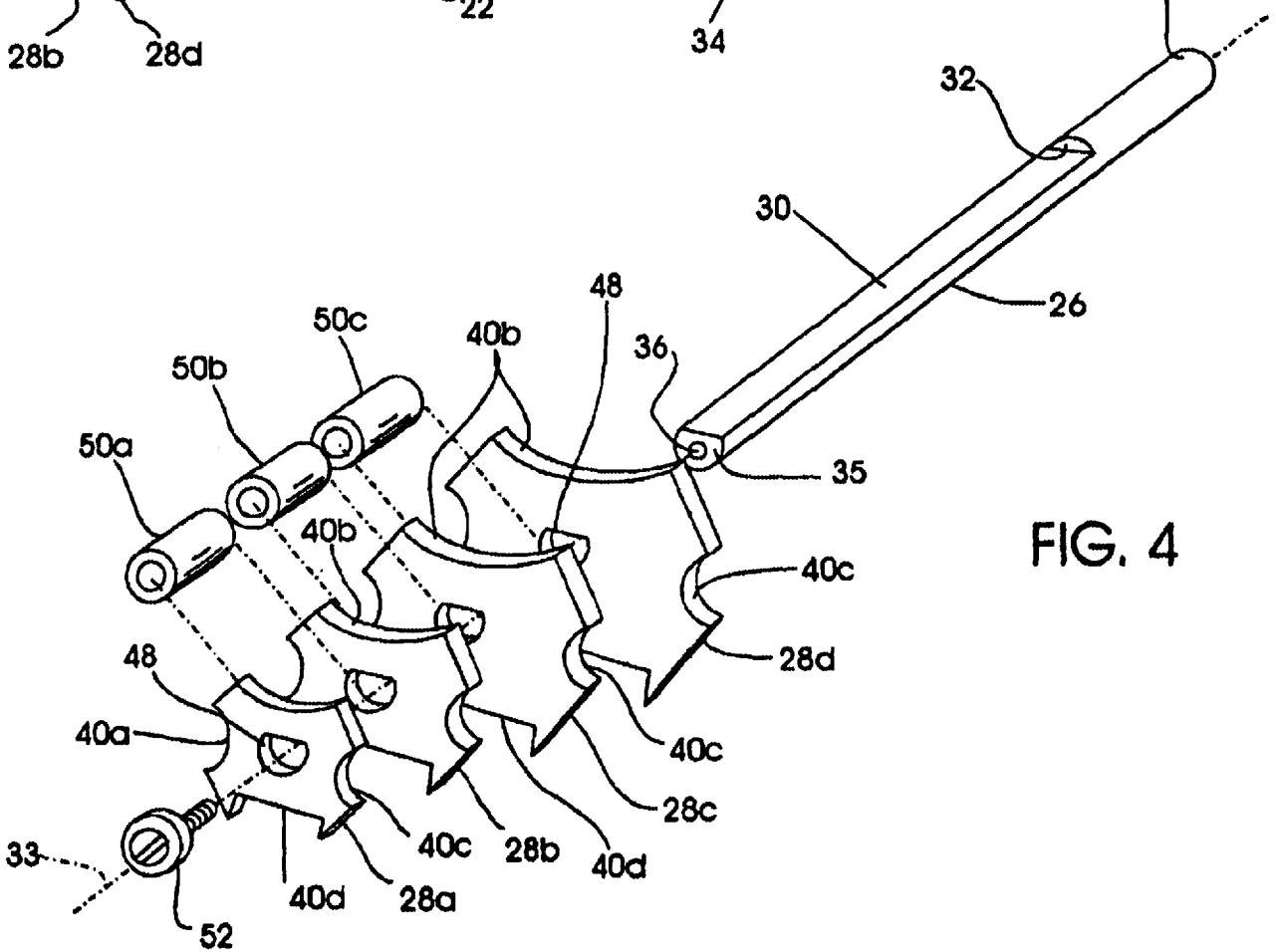
FIG. 4 is a fragmentary perspective view of the FIG. 2 embodiment, shown exploded.
Figure 5:
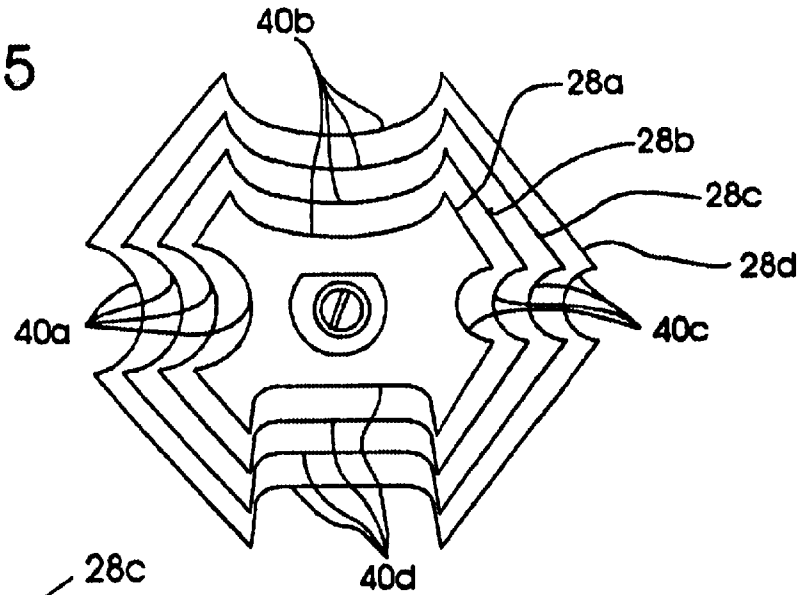
FIG. 5 is an end elevational view of the FIG. 2 embodiment as seen from the right in FIG. 3 and drawn to a slightly larger scale.

With reference to FIGS. 4 and 5, each cutting member 28*a*, 28*b*, 28*c* or 28*d* is constructed out of a flat piece of metal which is originally square in shape, but its corners are stamped, or notched, to form a series of four separate cutting edges 40*a*–40*d* which are spaced around the perimeter of the member. Every cutting edge 40*a*, 40*b*, 40*c* or 40*d* of any one cutting member possesses a contour (or shape) which is different from the contour (or shape) of any other cutting edge of the one cutting member, but the contour (or shape) of each cutting edge 40*a*, 40*b*, 40*c* or 40*d* of any cutting member matches (i.e. is substantially identical to) a corresponding cutting edge 40*a*, 40*b*, 40*c* or 40*d* of the cutting edges indicated 40*a* are substantially identical with one another, all of the cutting edges indicated 40*b* are substantially identical with one another, all of the cutting edges indicated 40*c* are substantially identical with one another, and all of the cutting edges indicated 40*d* are substantially identical with one another.

Furthermore, the cutting members 28*a*–28*d* are arranged in parallel relation with one another along the distal end portion 26 and so that the matching, or similarly-shaped, cutting edges provide four sets of parallel cutting edges disposed along the shaft 22. In other words, the cutting members 28*a*–28*d* are arranged along the distal end portion 26 so that all of the cutting edges indicated 40*a* provide one set of cutting edges, all of the cutting edges indicated 40*b* provide another set of cutting edges, all of the cutting edges indicated 40*c* provide still another set of cutting edges, and all of the cutting edges indicated 40*d* provide yet another set of cutting edges.

Figure 6:
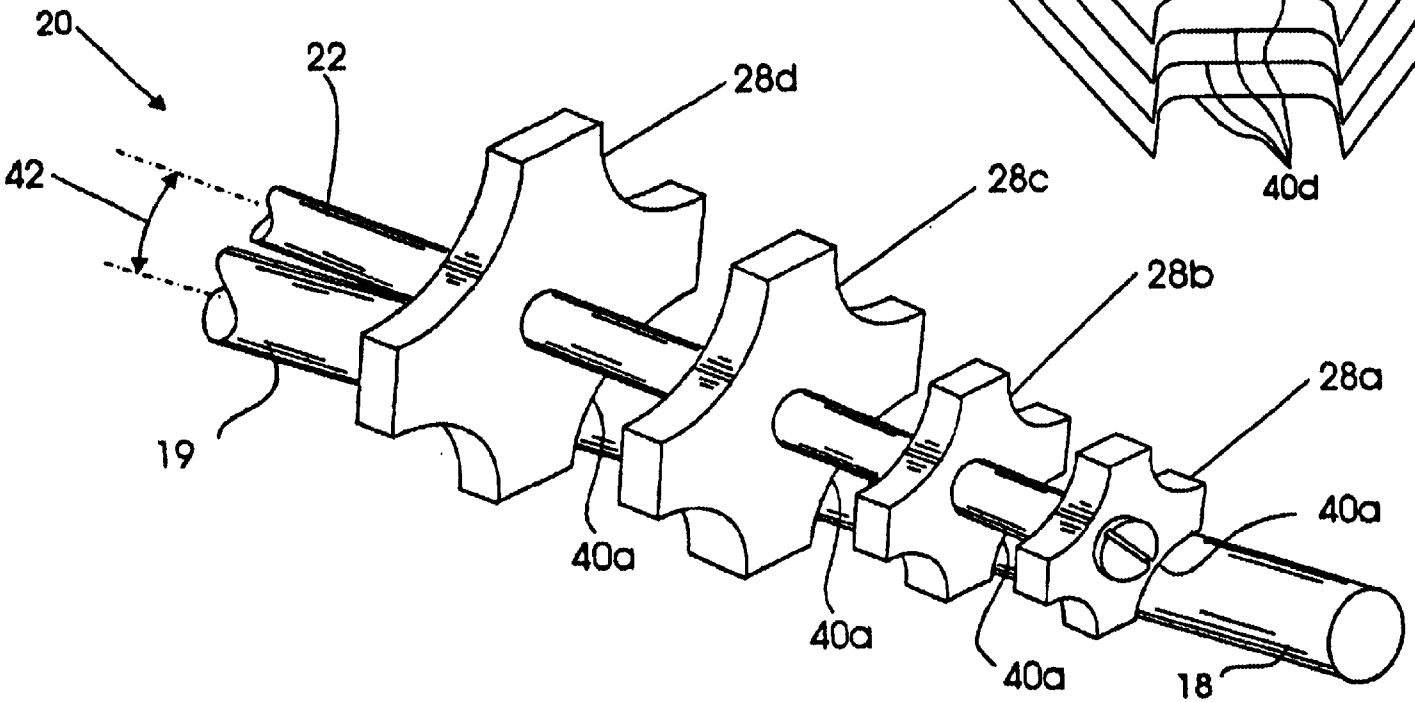
FIG. 6 is fragmentary perspective view illustrating the FIG. 2 embodiment being used to clean a surface of the grate of the grill of FIG. 1.

It is a feature of the tool 20 that the similarly-shaped cutting edges in each set of cutting edges are positioned in linear registry with one another. In the interests of the present invention, the similarly-shaped cutting edges are in "linear registry with one another" in that they are aligned with one another so that when any set of cutting edges is placed against the surface (e.g. a rod) of a grill grate for cleaning, as is illustrated in FIG. 6, each cutting edge in the set engages the grill grate surface. Thus, this "linear registry" of the cutting edges in each set enables the cutting members to be moved along a surface of a grill grate while each cutting edge in a set moves, or slides, in scraping engagement along the length of the surface.

In connection with the foregoing, all of the cutting members 28*a*–28*d* have the same thicknesses but are different in size (e.g. as measured across the faces thereof) and are positioned upon the distal end portion 26 so that the cutting members 28*a*–28*d* are arranged smallest to largest as a path is traced along the distal end portion 26 from the tip 35 thereof. With the cutting members 28*a*–28*d* arranged in this manner, the lines along which the cutting edges of the sets of cutting edges are in linear registry form an angle with the shaft 22. The advantage provided by the angular disposition of the lines of cutting edges and the shaft 22 is that the shaft 22 (which is straight along its entire length) can be held, by way of the handle 34, at an angle, such as is indicated 42 in FIG. 6, with respect to the grill rod 19 for moving the cutting members 28*a*–28*d* in scraping engagement therealong and still permit each cutting edge of a corresponding set of cutting edges to simultaneously engage the grill rod. In other words and inasmuch as grill grates are normally cleaned by someone standing alongside the grill, the angular disposition of the lines of the sets of cutting edges relative to the shaft 22 enables each cutting edge of a set to simultaneously engage or contact the surface (e.g. rod) of a grill grate for surface-cleaning purposes while the handle 34 is held by the hand of someone standing alongside the grill.

As best shown in FIG. 5, each cutting edge indicated 40*a* is semi-circular in shape (and thus well-suited for scraping surfaces of grill rods or bars having a circular cross section), each cutting edge 40*b* is arcuate in shape to resemble somewhat of a C (and thus well-suited for scraping surfaces of grill rods or bars having an oval cross section), each cutting edge indicated 40*c* is semi-circular in shape (and thus well-suited for scraping surfaces of grill rods or bars, such as wire rods, having a circular cross section whose diameters are smaller than those intended to be cleaned by the cutting edges 40*a*), and each cutting edge indicated 40*d* is U-shaped having a lengthy straight section (and thus well-suited for scraping surfaces of a grill rod or bar having a rectangular cross section).

Exemplary dimensions for the cutting edges are provided here as follows: The semi-circular cutting edge 40*a* can have a radius of about 5.3 mm, the arcuate-shaped cutting edge 40*b* can have a radius along its central section of about 22.5 mm and a radius along each of its end sections of about 5.0 mm, the semi-circular cutting edge 40*c* can have a radius of about 2.9 mm, and the U-shaped cutting edge 40*d* can have an opening across the U which measures about 15 mm and can have a depth of about 3.9 mm, and the two corners of the U (e.g. where the legs of the U meet the base of the U) can be provided with a radius of about 1.5 mm. Meanwhile, the thickness of each cutting member 28*a*–28*d* is about 3.17 mm, the distance as measured across the face of cutting member 28*a* (and between the opposite sides edges thereof) is about 0.958 mm, the distance as measured across the face of the cutting member 28*b* (and between the opposite side edges thereof) is about 1.133 mm, the distance as measured across the face of cutting member 28*c* (and between the opposite side edges thereof) is about 1.30 mm, and the distance as measured across the face of the cutting member 28*d* (and between the opposite side edges thereof) is about 1.467 mm. Furthermore, the diameter of the shaft 22 (as measured across its circular cross section) can be about 8.0 mm.

With reference again to FIG. 4 and to secure the cutting members 28*a*–28*d* upon the distal end portion 26 of the shaft 22, each cutting member 28*a*–28*d* includes a central aperture 48 sized to be closely accepted about the distal end portion 26, and the tool 20 includes three identical sleeve-like spacers 50*a*, 50*b* and 50*c*, and a small screw 52. As best seen in FIG. 4, the apertures 48 correspond in shape to the non-circular cross-sectional shape of the distal end portion 26 so that when the cutting members 28*a*–28*d* are positioned about the distal end portion 26, the apertures 48 and distal end portion 26 cooperate to prevent any rotation of the members 28*a*–28*d* about the distal end portion 26. By way of example, each spacer 50*a*, 50*b* or 50*c* can be about 13.0 mm long.

To assemble the cutting members 28*a*–28*d* upon the shaft 22 and with reference still to FIG. 4, the cutting member 28*d* is directed over the distal end portion 26 of the shaft 22 until the member 28*d* abuts the shoulder surface 32 formed along the distal end portion 26, a spacer 50*c* is then directed over the distal end portion 26 until the spacer 50*c* abuts the member 28*d*, then the cutting member 28*c* is directed over the distal end portion 26 until the member 28*c* abuts the spacer 50*c*, then another spacer 50*b* is directed over the distal end portion 26 until the spacer 50*b* abuts the member 28*c*, then the cutting member 28*b* is directed over the distal end portion 26 until the member 28*b* abuts the spacer 50*b*, then the remaining spacer 50*a* is directed over the distal end portion 26 until the spacer 50*a* abuts the cutting member 28*b*, and then the remaining cutting member 28*a* is directed over the distal end portion 26 until the member 28*a* abuts the spacer 50*a*. The small screw 52 is then inserted and subsequently tightened within the internally-threaded opening 36 provided in the tip 35 of the distal end portion 26 so that the arrangement of cutting members 28*a*–28*d* and spacers 50*a*–50*c* is tightly held between the head of the screw 52 and the shoulder surface 32.

To use the tool 20 and with reference to FIG. 6, the handle 34 (FIG. 2) of the tool 20 is grasped by the hand of a user and the cutting edges of (a set of cutting edges of) the cutting members 28*a*–28*d* are placed in engagement with the rod 19 of a grill grate. Which set of cutting edges are selected for positioning in engagement with the rod 19 is normally dictated by the cross-sectional shape of the rod 19. For example, if the rod 19 is circular in shape, the cutting edges indicated 40*a* or the cutting edges 40*c* would be selected for use. (Since cutting edges 40*c* are slightly smaller than cutting edges 40*a*, the cutting edges 40*c* will accommodate, or nestingly accept, a rod or wire rod of smaller diameter than that accommodated by the cutting edges 40*a*.) Furthermore, if the rod 19 were oval in shape, the cutting edges 40*b* would be selected for use, and if the rod 19 were rectangular in shape, the cutting edges 40*d* would be selected for use.

With the selected cutting edges of the cutting members 28*a*–28*d* positioned in engagement with the rod 19, the distal end portion 26 of the tool 20 is manually moved back and forth along the rod 19 of the grill as the cutting edges are guided in scraping engagement with the rod 19. As the cutting edges are moved in scraping engagement with the rod 19, cooking deposits, such as grime and food residue, and any rust or corrosion which has accumulated upon the surface of the rod 19 is loosened and cut from rod 19 by the cutting edges. Because all of the cutting edges of each set of cutting edges are moved in scraping engagement with the grill rod 19 as the cutting members 28*a*–28*d* are moved therealong, the grill rod 19 is readily cleaned and with fewer back and forth movements (and consequently less effort) than would otherwise be required to satisfactorily clean a grill rod 19 with a grill cleaning tool having only a single cutting edge. Accordingly, the plurality of cutting edges provided by the cutting members 28*a*–28*d* and which are in simultaneous engagement with the grill rod 19 is advantageous in this respect.

It also follows that the different shapes and contours of the cutting edges of the four sets of cutting edges enable the tool 20 to be used to clean any of a number of grill rods having rods of different shapes and contours. For example and as mentioned earlier, the two sets of cutting edges 40*a* and 40*c* having a semi-circular shape have been found to be well-suited for cleaning material from grill rods of circular cross section, the set of cutting edges 40*b* having an arcuate shape has been founded to be well-suited for cleaning material from a grill rod of oval cross section, and the set of cutting edges 40*d* having a lengthy straight section has been found to be well-suited for cleaning material from grill rods having rectangular cross sections, and consequently flat surfaces.

It will be understood that numerous modifications and substitutions can be had to the aforedescribed embodiment without departing from the spirit of the invention. For example, although the aforedescribed embodiment 20 has been shown and described as including four planar cutting members 28*a*–28*d* and four sets of cutting edges 40*a*–40*d*, a tool in accordance with the broader aspects of the present invention can possess an alternative number of cutting members and an alternative number of sets of cutting edges. For example, such a tool would include as few as two cutting members.

Further still and although the tool 20 has been shown and described as including a shaft 22 which is straight along its entire length, a shaft of a tool in accordance with the broader aspects of the invention can be bent at selected locations along its length. Accordingly, the aforedescribed embodiment is intended for the purpose of illustration and not as limitation.

What is claimed is:

1. A grill cleaning tool for cleaning a surface of a grill grate, the tool comprising:

an elongate shaft having a proximal end portion capable of being grasped by a user and a distal end portion, and a plurality of substantially planar cutting members attached to the distal end portion of the shaft in a substantially parallel relationship to one another and each arranged generally normal to the axis of the shaft, the planar cutting members being arranged in a spaced relationship along the axis of the shaft, each of the cutting members being of a different size wherein they are arranged on the distal end portion from smaller to larger in a direction toward the proximal end portion, each of the cutting members including a plurality of cutting edges arranged about the periphery thereof and the plurality of cutting edges of each respective cutting member being different in shape or size than the other edges thereof, the cutting edges of each cutting member having an associated cutting edge of the other cutting members which is substantially identical with the shape thereof so as to define a set of identical cutting edges, the cutting edges of each set being in substantially linear registry with one another so that each of the cutting edges within each set can be placed in simultaneous engagement with and guided along the surface of a grill grate in scraping engagement therewith.

2. A grill cleaning tool for use when scraping a surface of a grill grate, the tool comprising:

an elongated shaft having a proximal end portion capable of being grasped by a user for use of the tool and a distal end portion opposite the proximal end portion; and means associated with the distal end portion defining a plurality of cutting edges disposed in linear registry with one another so that by moving the distal end portion along the length of a surface of a grill grate, each of the plurality of cutting edges is guided in scraping engagement with the surface; and the associated means includes a plurality of substantially planar cutting members attached to the distal end portion of the shaft in a substantially parallel and spaced relationship to one another and each arranged generally normal to the axis of the shaft, the planar cutting members having edges which provide the cutting edges of the associated means and each cutting member being of a different size from every other cutting member of the cutting members and wherein the cutting members are arranged along the distal end portion from the smaller to the larger as a path is traced therealong in a direction toward the proximal end portion, each of cutting members including a plurality of cutting edges arranged about the periphery thereof and the plurality of cutting edges of each respective cutting member being different in shape or size from the shape or size of the other cutting edges thereof, the cutting edges of each cutting member having an associated cutting edge defined by the other cutting members which is identical with the shape thereof and so as to define a set of substantially identical cutting edges, the cutting edges of each set being in substantially linear registry with one another so that each of the cutting edges within each set can be placed in simultaneous engagement with and guided along the surface of a grill grate in scraping engagement therewith.

3. The grill cleaning tool as defined in claim 2 wherein there are four cutting members attached to the distal end portion and each cutting member defines four cutting edges about its perimeter.

* * * * *